US008714065B2

(12) United States Patent
Takahashi et al.

(10) Patent No.: US 8,714,065 B2
(45) Date of Patent: May 6, 2014

(54) PUNCHING DIE

(75) Inventors: Yukio Takahashi, Kanagawa (JP); Satoshi Shimizu, Kanagawa (JP); Hiroshi Nakai, Kanagawa (JP)

(73) Assignee: Amada Company, Limited, Kanagawa (JP)

( * ) Notice: Subject to any disclaimer, the term of this patent is extended or adjusted under 35 U.S.C. 154(b) by 0 days.

(21) Appl. No.: 11/719,496

(22) PCT Filed: Nov. 18, 2005

(86) PCT No.: PCT/JP2005/021243

§ 371 (c)(1), (2), (4) Date: Jul. 10, 2007

(87) PCT Pub. No.: WO2006/054694

PCT Pub. Date: May 26, 2006

(65) Prior Publication Data

US 2008/0092713 A1 Apr. 24, 2008

(30) Foreign Application Priority Data

Nov. 19, 2004 (JP) ..... 2004-336155
Nov. 24, 2004 (JP) ..... 2004-339473

(51) Int. Cl.

| | |
|---|---|
| ***B26D 7/06*** | (2006.01) |
| ***B21D 28/34*** | (2006.01) |
| ***B26D 7/26*** | (2006.01) |
| *B21D 45/00* | (2006.01) |

(52) U.S. Cl.

CPC ..... *B21D 28/34* (2013.01); *B21D 45/006* (2013.01); *B26D 7/2628* (2013.01)

USPC ..... 83/123; 83/686; 83/698.91

(58) Field of Classification Search

USPC ..... 83/686, 140, 111, 123, 126, 698.91, 83/527

See application file for complete search history.

(56) References Cited

U.S. PATENT DOCUMENTS 4,375,774 A * 3/1983 Wilson et al. ..... 83/140
4,843,930 A * 7/1989 Ashbolt ..... 83/39

(Continued)

FOREIGN PATENT DOCUMENTS

JP 1-80223 5/1989
JP 1-080223 5/1989

(Continued)

OTHER PUBLICATIONS

Japan Office action, mail date is Jul. 24, 2012.

(Continued)

*Primary Examiner* — Sean Michalski

(74) *Attorney, Agent, or Firm* — Greenblum & Bernstein, P.L.C.

(57) ABSTRACT

Provided is a punch tool which enables improvement in accuracy of processing a work by suppressing rattling between a punch body and a punch guide and eliminating almost all steps in a punched surface (cut surface) of the work. A punch tool includes a cylindrical punch guide; a punch body movably provided in the vertical directions in the punch guide; a punch head provided at an upper end of the punch body; a stripper spring provided on a lower side of the punch head; and a plurality of rotation control modules including key grooves and formed so as to vertically extend in the punch guide or the punch body and keys and which are provided in the punch body or the punch guide and are movably fitted in the vertical directions to the key grooves.

2 Claims, 6 Drawing Sheets

(56) References Cited

U.S. PATENT DOCUMENTS

| | | | | |
|---|---|---|---|---|
| 4,993,294 | A * | 2/1991 | Chun et al. | 83/139 |
| 5,176,057 | A * | 1/1993 | Chun et al. | 83/139 |
| 5,419,225 | A * | 5/1995 | Fujita | 83/140 |
| 5,545,116 | A * | 8/1996 | Seto | 483/29 |
| 5,575,168 | A * | 11/1996 | Rosene et al. | 72/179 |
| 5,647,256 | A * | 7/1997 | Schneider | 83/140 |
| 5,662,016 | A * | 9/1997 | Fujita | 83/137 |
| 5,839,341 | A * | 11/1998 | Johnson et al. | 83/530 |
| 5,934,165 | A * | 8/1999 | Chatham | 83/588 |
| 6,276,247 | B1 * | 8/2001 | Helda | 83/684 |
| 6,311,594 | B1 * | 11/2001 | Ootsuka | 83/138 |
| 6,334,381 | B1 * | 1/2002 | Chatham | 83/588 |
| 6,755,110 | B2 * | 6/2004 | Rosene et al. | 83/686 |
| 6,782,787 | B2 * | 8/2004 | Morehead et al. | 83/679 |
| 6,895,849 | B2 * | 5/2005 | Rosene et al. | 83/698.41 |
| 7,007,582 | B2 * | 3/2006 | Iwamoto et al. | 83/686 |
| 7,156,009 | B2 * | 1/2007 | Iwamoto et al. | 83/686 |
| 7,168,356 | B2 * | 1/2007 | Rosene et al. | 83/686 |
| 2002/0053272 | A1 * | 5/2002 | Phlipot | 83/686 |
| 2003/0024367 | A1 * | 2/2003 | Morehead et al. | 83/686 |
| 2004/0206223 | A1 * | 10/2004 | Rosene et al. | 83/686 |
| 2006/0060046 | A1 * | 3/2006 | Sugizaki et al. | 83/138 |

FOREIGN PATENT DOCUMENTS

| | | |
|---|---|---|
| JP | 3-189021 | 8/1991 |
| JP | 4-197532 | 7/1992 |
| JP | 4-129514 | 11/1992 |
| JP | 06-000551 | 1/1994 |
| JP | 8-021339 | 1/1996 |
| JP | 8-21339 | 1/1996 |
| JP | 8-504369 | 5/1996 |
| JP | 8-281348 | 10/1996 |
| JP | 09-273564 | 10/1997 |
| JP | 2000-351024 | 12/2000 |
| JP | 2001-079621 | 3/2001 |
| JP | 2002-45932 | 2/2002 |
| JP | 2002-045932 | 2/2002 |
| JP | 2002-205130 | 7/2002 |
| JP | 2002-282962 | 10/2002 |
| JP | 2002-310176 | 10/2002 |
| JP | 2003-245737 | 9/2003 |
| WO | 94/07663 | 4/1994 |
| WO | 03/103872 | 12/2003 |

OTHER PUBLICATIONS

Japan Office action, mail date is Oct. 30, 2012.
Japanese Office Action dated Jul. 16, 2013, with an English translation thereof.
English language Abstract of JP 2002-205130, Jul. 23, 2002.
English language Abstract of JP 2002-45932, Feb. 12, 2002.
English language Abstract of JP 4-197532, Jul. 17, 1992.
English language Abstract of JP 8-21339, Jan. 23, 1996.
English language Abstract of JP 3-189021, Aug. 19, 1991.
English language Abstract of JP 8-281348, Oct. 29, 1996.

* cited by examiner (A)

(B)

PUNCHING DIE

TECHNICAL FIELD

The present invention relates to a punch tool used when punching is performed for a part to be processed in a sheet-like work, and more particularly relates to a punch tool used while being attached to a punch press such as a turret punch press, for example.

BACKGROUND ART

A general punch tool will be briefly described below.

Specifically, the punch tool is held by a punch tool holding member in a punch press, and includes a cylindrical punch guide. Moreover, the punch guide has, on its lower side, a stripper part which presses a periphery of a part to be processed in a sheet-like work. In the stripper part, an insertion hole is formed.

In the punch guide, a punch body is movably provided in the vertical directions. The punch body has, on its lower side, a blade part which can be inserted into the insertion hole. Note that the blade part of the punch body can enter into a die hole in a die tool held by a die tool holding member in the punch press. Moreover, a punch head is provided at an upper end of the punch body, and a stripper spring which can bias the punch body is provided on a lower side of the punch head.

Furthermore, the punch tool includes one rotation control means for controlling rotation of the punch body with respect to the punch guide. The rotation control means includes: a key groove formed so as to vertically extend in the punch guide; and a key which is provided in the punch body and is movably fitted to the key groove in the vertical directions.

Accordingly, the work is moved in a horizontal direction to be set at a position for processing by the punch press. Thereafter, a ram in the punch press is moved downward, and the punch head is pressed from above. Accordingly, the entire punch tool is moved downward, and a periphery of a part to be processed in the work is pressed by the stripper part of the punch guide. Furthermore, by moving the ram downward, the punch body is moved downward relative to the punch guide against a biasing force of the stripper spring. Accordingly, the blade part of the punch body is inserted into the insertion hole. Thus, the punch tool and the die tool are allowed to collaborate to subject the part to be processed in the work to punching. Consequently, processed holes can be formed in the work. Note that, after having been moved downward, the ram is moved upward to return to its initial position.

Moreover, in the case where the work is subjected to nibbling, first, as described above, the processed holes are formed in the work. Thereafter, while slightly moving the work in the horizontal direction, the ram is repeatedly moved up and down. Thus, by allowing the punch tool and the die tool to continuously collaborate many times, slits, notches or the like having a predetermined shape can be formed in the work.

Note that, as a prior art relevant to the present invention, there is Japanese Patent Application Laid-open Publication No. Hei 8 (1996)-281348 (Patent Document 1).

Meanwhile, in order to fit the key to the key groove, it is required to set a width of the key groove to be slightly larger than a width of the key. For a minute clearance between the key groove and the key, the punch body is allowed to be displaced in a circumferential direction. Moreover, the circumferential displacement of the punch body can be suppressed to be smaller by improving fitting accuracy between the key and the key groove to reduce the minute clearance between the key and the key groove. However, improvement in the fitting accuracy between the key and the key groove increases costs of processing the punch tool and complicates fitting in assembly of the punch tool. Thus, it is not desirable to improve the fitting accuracy between the key and the key groove more than necessary. Therefore, in the case where the work is subjected to nibbling by allowing the punch tool and the die tool to continuously collaborate many times, rattling is caused between the punch body and the punch guide. Thus, there is a problem that accuracy of processing the work is deteriorated due to steps or the like caused in a punched surface (cut surface) of the work.

Meanwhile, a punch tool used while being attached to a punch press such as a turret punch press, for example, generally has a configuration as shown in FIG. 1. Specifically, in a punch tool 101, a punch driver 109 is movably fitted in the vertical directions to a cylindrical punch guide 107 movably supported in the vertical directions through a lifter spring 105 on a punch holder 103 such as an upper turret in a punch press. Between a punch head 111 provided on an upper end of the punch driver 109 and the punch guide 107, a stripper spring 113 is provided. Moreover, a punch body 115 including a punch blade part 115B on its lower end is detachably attached to a lower side of the punch driver 109 by means of an attachment bolt 117 and a key 119.

In the above configuration, even if the punch blade part 115B varies in shape, the punch guide 107, the punch driver 109 and the like can be commonly used by replacing the punch body 115. However, since the punch body 115 is relatively large, in the case where the entire punch body 115 is manufactured by using high-speed steel, cemented carbide or the like, there is a problem that much waste is incurred.

Therefore, there has been also proposed a configuration in which the punch body 115 is divided into a part of a punch chip including the punch blade part and a main body part of the punch body, and the punch chip is detachably attached to the main body part of the punch body.

Note that, as the foregoing relevant prior art, there is Japanese Patent Application Laid-open Publication No. 2002-45932 (Patent Document 2).

The following is a configuration of attaching a punch chip to a punch body according to the invention described in Patent Document 2.

Specifically, as shown in FIG. 2, instead of the punch body 115, a punch body 121 that can be attached to/detached from the punch driver 109 and a punch chip 123 including a punch blade part 123B are combined. In an upper surface of the punch body 121, a screw hole 125, into which the attachment bolt 117 can be screwed, and also a key groove 127, to/from which the key 119 is fitted/removed, are formed. Therefore, the punch body 121, instead of the conventional punch body 115, can be attached to the punch driver 109.

In a lower surface of the punch body 121, a screw hole 131 is formed, into which an attachment bolt 129 as an example of attachment tools can be screwed, the attachment bolt penetrating the punch chip 123 from below. Moreover, in the lower surface of the punch body, a plurality of pin holes 135 are provided, in which positioning pins 133 as an example of the attachment tools are attached. The punch chip 123 attached to the lower surface of the punch body 121 has a configuration including pin holes 137 as attachment holes, into/from which the positioning pins 133 are fitted/removed, and a through hole 139 through which the attachment bolt 129 can penetrate. The through hole 139 is provided in the center of the punch chip 123, and the pin holes 137 are provided at symmetrical positions on both sides of the through hole 139.

Therefore, when the punch chip 123 is attached to the punch body 121, even if the punch chip 123 is rotated in an arbitrary direction around an axis center of the through hole 139, the punch chip 123 can be attached to the punch body 121. Thus, the attachment can be facilitated.

However, in the case where, despite that dimensions of the punch chip 123 from its left end face to its right end face are within an allowable range, for example, a manufacturing error in manufacturing of the punch chip 123 causes a slight difference between a dimension from the axis center of the through hole 139 to the left end face and a dimension from the axis center thereof to the right end face, it is necessary to find out whether the through hole 139 is closer to the right end or closer to the left end from the center of the punch chip 123. Specifically, a fine adjustment of a clearance between a die hole provided in a die and the punch chip 123 is sometimes made so as not to set the clearance closer to one side.

Therefore, even if a dimensional deviation to one side or the like due to the manufacturing error in manufacturing of the punch chip 123 has been found out in manufacturing, the dimensional deviation to one side becomes unfindable when the punch chip 123 is attached to the punch body 121. Thus, there is a problem that it is necessary to make measurements again.

The present invention was made to solve the problems as described above. It is a first object of the present invention to provide a punch tool which enables improvement in accuracy of processing a work by suppressing rattling between a punch body and a punch guide when nibbling is performed and by eliminating almost all steps or the like in a punched surface (cut surface) of the work.

It is a second object of the present invention to provide a punch tool which makes it possible to easily find out the deviation to one side as a dimensional error even after a punch chip is attached to a punch body.

DISCLOSURE OF INVENTION

In order to achieve the first object, a first aspect of the present invention is a punch tool used when punching is performed for a part to be processed in a sheet-like work. The punch tool includes: a cylindrical punch guide having, on its lower side, a stripper part which presses a periphery of the part to be processed in the work, the stripper part having an insertion hole formed therein; a punch body which is movably provided in the vertical directions in the punch guide and has, on its lower side, a blade part that can be inserted into the insertion hole; a punch head provided at an upper end of the punch body; a stripper spring which is provided on a lower side of the punch head and can bias the punch body downward; and a plurality of rotation control means for controlling rotation of the punch body with respect to the punch guide, each rotation control means including a key groove formed so as to vertically extend in the punch guide or the punch body and a key which is provided in the punch body or the punch guide and is movably fitted in the vertical directions to the key groove.

According to the first aspect of the present invention, in a state where the punch tool is previously held by a punch tool holding member in a punch press and a die tool is previously held by a die tool holding member in the punch press, the work is moved in a horizontal direction to be set at a position for processing by the punch press. Thereafter, a ram in the punch press is moved downward, and the punch head is pressed from above. Accordingly, the entire punch tool is moved downward, and the periphery of the part to be processed in the work is pressed by the stripper part of the punch guide. Furthermore, by moving the ram downward, the punch body is moved downward relative to the punch guide against a biasing force of the stripper spring. Accordingly, the blade part of the punch body is inserted into the insertion hole. Thus, the punch tool and the die tool are allowed to collaborate to subject the part to be processed in the work to punching. Consequently, processed holes can be formed in the work. Note that, after having been moved downward, the ram is moved upward to return to its initial position.

Moreover, in the case where the work is subjected to nibbling, first, as described above, the processed holes are formed in the work. Thereafter, while slightly moving the work in the horizontal direction, the ram is repeatedly moved up and down. Thus, by allowing the punch tool and the die tool to continuously collaborate many times, slits, notches or the like having a predetermined shape can be formed in the work.

Here, the punch tool includes the plurality of rotation control means for controlling rotation of the punch body with respect to the punch guide. Thus, the direction of the punch body can be accurately maintained by effectively reducing an allowable displacement of the punch body in a circumferential direction.

As a second aspect according to the first aspect of the present invention, in the punch tool, the plurality of rotation control means are first rotation control means and second rotation control means. The first and second rotation control means are configured so as to be symmetrical with respect to an axis center of the punch body.

According to the second aspect of the present invention, the first and second rotation control means are configured so as to be symmetrical with respect to the axis center of the punch body. Thus, even if the punch body tends to be displaced in the circumferential direction around the vicinity of one of the rotation control means, the other rotation control means can suppress the displacement.

Therefore, the direction of the punch body can be accurately maintained by effectively reducing the allowable displacement of the punch body in the circumferential direction. Thus, accuracy of processing the work can be improved by allowing the punch tool and the die tool to continuously collaborate many times, suppressing rattling between the punch body and the punch guide when the work is subjected to nibbling, and eliminating almost all steps or the like in a punched surface (cut surface) of the work.

Particularly, according to the second aspect of the present invention, even if the punch body tends to be displaced in the circumferential direction around the vicinity of one of the rotation control means, the other rotation control means can suppress the displacement. Thus, the rattling between the punch body and the punch guide is further suppressed. Consequently, the work processing accuracy can be further improved.

In order to achieve the second object, a third aspect of the present invention is a punch tool in which a punch body is movably provided in the vertical directions in a punch guide and a punch chip is detachably provided in the punch body. In the punch tool, one positioning locking part is provided for positioning the punch chip with respect to the punch body. The positioning locking part is provided at a position away from a center position of the punch chip.

In a punch tool based on a fourth aspect of the present invention, a punch body movably provided in the vertical directions in a punch guide is vertically adjustably provided by screw-fitting to a punch driver movably provided in the vertical directions in an upper part of the punch guide. Moreover, one positioning locking part is provided for positioning a punch chip detachably attached to a lower part of the punch body. The positioning locking part is provided at a position away from a center position of the punch chip.

In a punch tool based on a fifth aspect of the present invention, a punch body movably provided in the vertical directions in a punch guide is vertically adjustably provided by screw-fitting to a punch driver movably provided in the vertical directions in an upper part of the punch guide. Moreover, two positioning locking parts are provided for positioning a punch chip detachably attached to a lower part of the punch body. The two positioning locking parts are provided at asymmetrical positions with respect to a center position of the punch chip.

According to the third to fifth aspects of the present invention, when the punch chip is attached to the punch body, the direction of the punch chip is always set constant with respect to the punch body. Therefore, in the case where an error in manufacturing of the punch chip causes a dimensional error of the punch chip, such as deviation to one side, it is possible to easily find out the deviation to one side as the dimensional error even after the punch chip is attached to the punch body.

BEST MODE FOR CARRYING OUT THE INVENTION

With reference to FIGS. 3 to 6, embodiments of the present invention will be described below.

Figure 3:
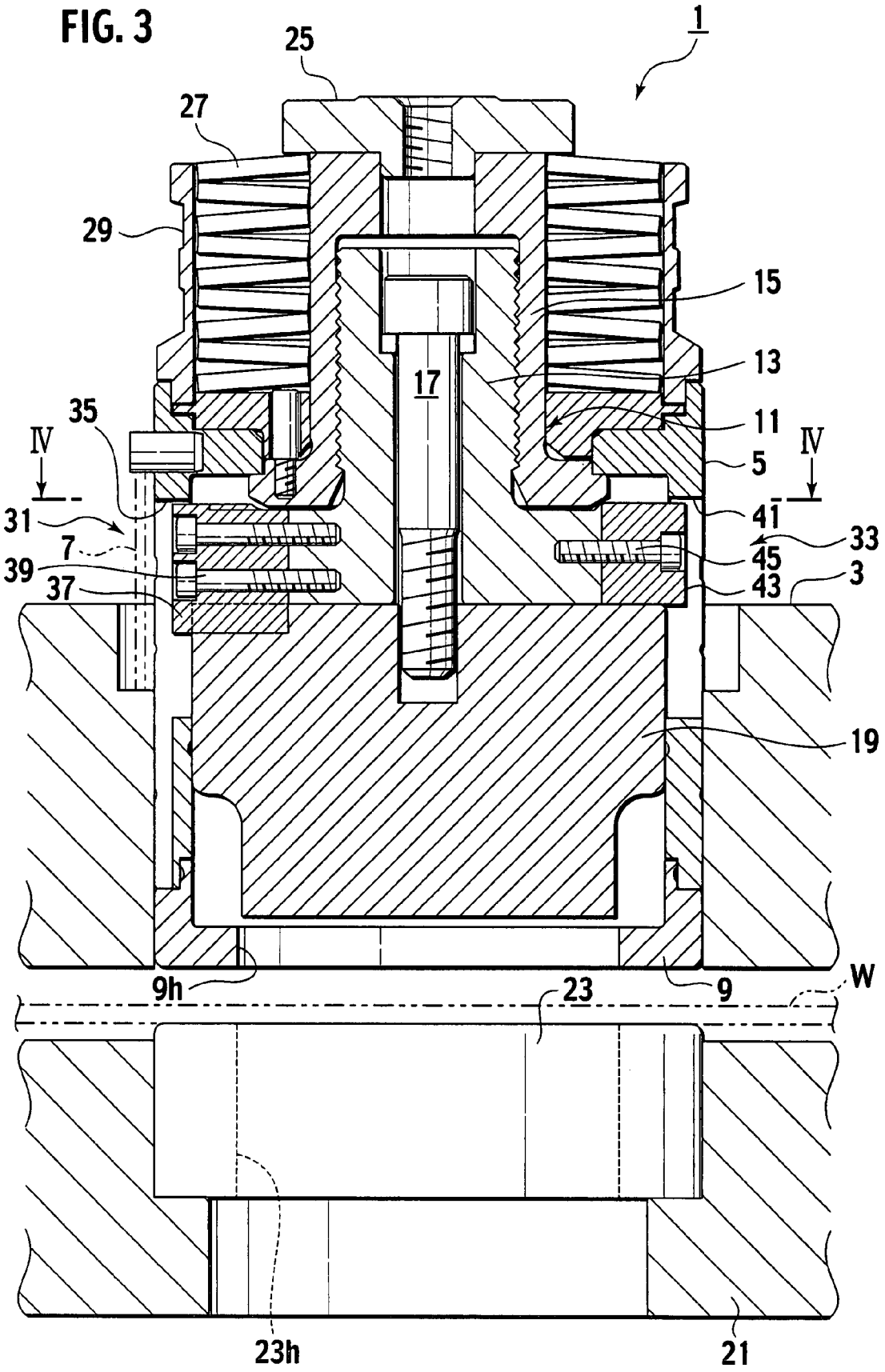
FIG. 3 is a cross-sectional view of a punch tool according to a first embodiment of the present invention, also showing a die tool.
Figure 4:
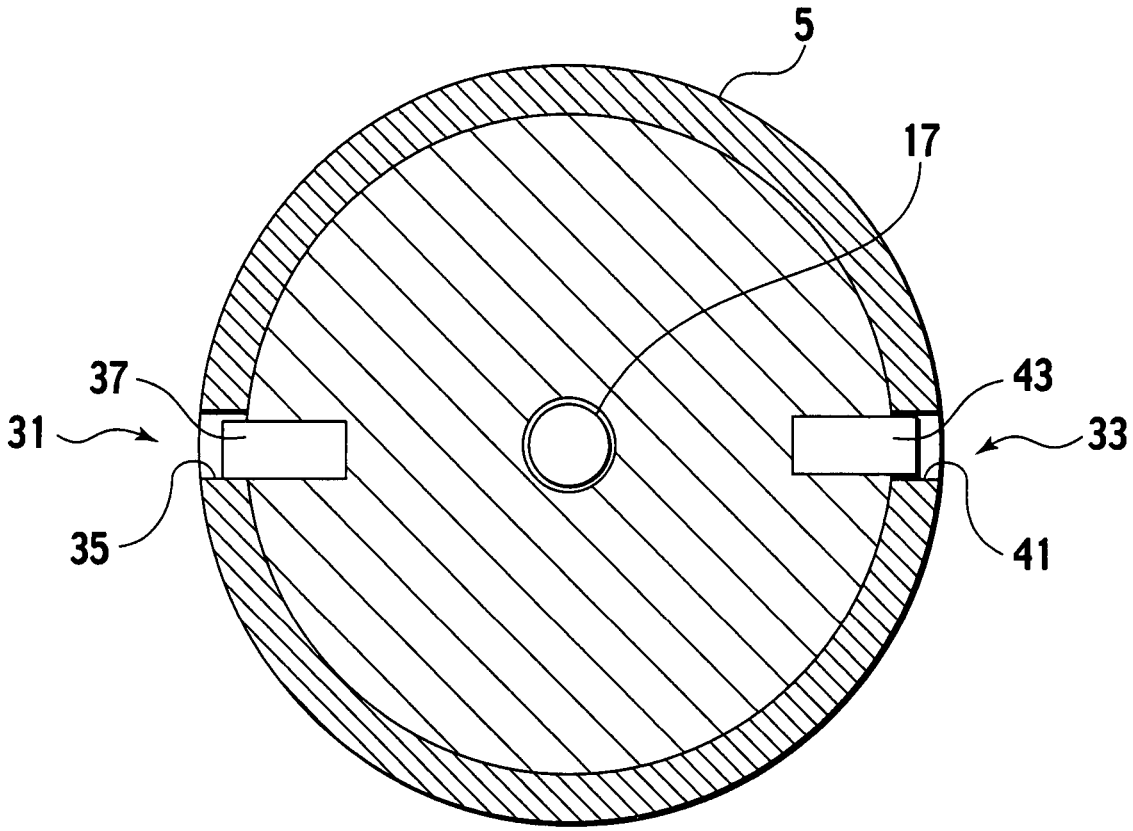
FIG. 4 is a view along the line IV-IV in FIG. 3.

Here, FIG. 3 is a cross-sectional view of a punch tool according to a first embodiment of the present invention, and FIG. 4 is a view along the line IV-IV in FIG. 3.

As shown in FIGS. 3 and 4, a punch tool 1 according to the embodiment of the present invention is used when punching is performed for a part to be processed in a sheet-like work (a sheet-like workpiece) W, and is held by a punch tool holding member 3 in a punch press. The following is a specific configuration of the punch tool 1.

Specifically, the punch tool 1 includes a cylindrical punch guide 5. The punch guide 5 is held by a plurality of (only one thereof is shown) lifter springs 7 so as to be vertically (a vertical direction in FIG. 3, and a front and back direction on the page space in FIG. 4) movable with respect to the punch tool holding member 3. Moreover, the punch guide 5 has, on its lower side, a stripper plate (stripper part) 9. In the stripper plate 9, an insertion hole **9*h*** is formed.

In the punch guide 5, a punch body 11 is movably provided in the vertical directions. Here, the punch body 11 includes: a main body 13 movably provided in the vertical directions in the punch guide 5; a body cap 15 provided by screw-fitting to an upper part of the main body 13; and a punch blade (blade part) 19 detachably provided on a lower surface of the main body 13 by use of an attachment bolt 17. Note that the punch blade 19 can enter into a die hole **23*h* in a die tool 23 held by a die tool holding member 21** in the punch press.

A punch head 25 is provided at an upper end of the body cap 15. Below the punch head 25, a stripper spring 27 is provided, which can bias the punch body 11. Note that a biasing force of the stripper spring 27 is larger than biasing forces of the plurality of lifter springs 7. Moreover, on an upper end of the punch guide 5, a protection sleeve 29 surrounding a periphery of the stripper spring 27 is provided.

Furthermore, the punch tool 1 includes first and second rotation control means (rotation control modules) 31 and 33 for controlling rotation of the punch body 11 with respect to the punch guide 5. The first and second rotation control means 31 and 33 are configured so as to be symmetrical with respect to an axis center of the punch body 11.

To be more specific, in the punch guide 5, a first key groove 35 which forms a part of the first rotation control means 31 is formed so as to extend vertically. In a peripheral part of the main body 13, a first key 37 movably fitted in the vertical directions to the first key groove 35 is detachably provided by use of an attachment bolt 39. Note that the first key groove 35 may be formed in the peripheral part of the main body 13 instead of the punch guide 5, and the first key 37 may be provided in the punch guide 5 instead of the peripheral part of the main body 13.

In the punch guide 5, a second key groove 41 which forms a part of the second rotation control means 33 is formed so as to extend vertically. The second key groove 41 is symmetrical to the first key groove 35 with respect to the axis center of the punch body 11 (in other words, an axis center of the punch guide 5). Moreover, in the peripheral part of the main body 13, a second key 43 movably fitted in the vertical directions to the second key groove 41 is detachably provided by use of an attachment bolt 45. The second key 43 is symmetrical to the first key 37 with respect to the axis center of the punch body 11. Note that the second key groove 41 may be formed in the peripheral part of the main body 13 instead of the punch guide 5, and the second key 43 may be provided in the punch guide 5 instead of the peripheral part of the main body 13.

Next, operations according to the embodiment of the present invention will be described.

In a state where the punch tool 1 is previously held by the punch tool holding member 3 and the die tool 23 is previously held by the die tool holding member 25, the work W is moved in a horizontal direction to be set at a position for processing by the punch press. Thereafter, a ram (not shown) in the punch press is moved downward, and the punch head 25 is pressed from above. Thus, the entire punch tool 1 is moved downward against the biasing forces of the plurality of lifter springs 7. Accordingly, the periphery of the part to be processed in the work W is pressed by the stripper plate 9 of the punch guide 5. Furthermore, by moving the ram downward, the punch body 11 is moved downward relative to the punch guide 5 against the biasing force of the stripper spring 27. Accordingly, the punch blade 19 of the punch body 11 is inserted into the insertion hole **9*h*. Thus, the punch tool 1 and the die tool 23** are allowed to collaborate to subject the part to be processed in the work W to punching. Consequently, processed holes can be formed in the work W. Note that, after having been moved downward, the ram is moved upward to return to its initial position.

Moreover, in the case where the work W is subjected to nibbling, first, as described above, the processed holes are formed in the work W. Thereafter, while slightly moving the work W in the horizontal direction, the ram is repeatedly moved up and down. Thus, by allowing the punch tool 1 and the die tool 23 to continuously collaborate many times, slits, notches or the like having a predetermined shape can be formed in the work W.

Here, the punch tool 1 includes two rotation control means (the first and second rotation control means 31 and 33) for controlling rotation of the punch body 11 with respect to the punch guide 5. Thus, the direction of the punch body 11 can be accurately maintained by effectively reducing an allowable displacement of the punch body 11 in a circumferential direction. Moreover, the first and second rotation control means 31 and 33 are configured so as to be symmetrical with respect to the axis center of the punch body 11. Thus, even if the punch body 11 tends to be displaced in the circumferential direction around the vicinity of the first rotation control means 31 (or the second rotation control means 33), the second rotation control means 33 (or the first rotation control means 31) can suppress the displacement.

As described above, according to the embodiment of the present invention, the direction of the punch body 11 can be accurately maintained by effectively reducing the allowable displacement of the punch body 11 in the circumferential direction. Thus, accuracy of processing the work W can be improved by allowing the punch tool 1 and the die tool 23 to continuously collaborate many times, suppressing rattling between the punch body 11 and the punch guide 5 when the work W is subjected to nibbling, and eliminating almost all steps or the like in a punched surface (cut surface) of the work W.

Particularly, even if the punch body 11 tends to be displaced in the circumferential direction around the vicinity of the first rotation control means 31 (or the second rotation control means 33), the second rotation control means 33 (or the first rotation control means 31) can suppress the displacement. Thus, the rattling between the punch body 11 and the punch guide 5 is further suppressed. Consequently, the work processing accuracy can be further improved.

Figure 1:
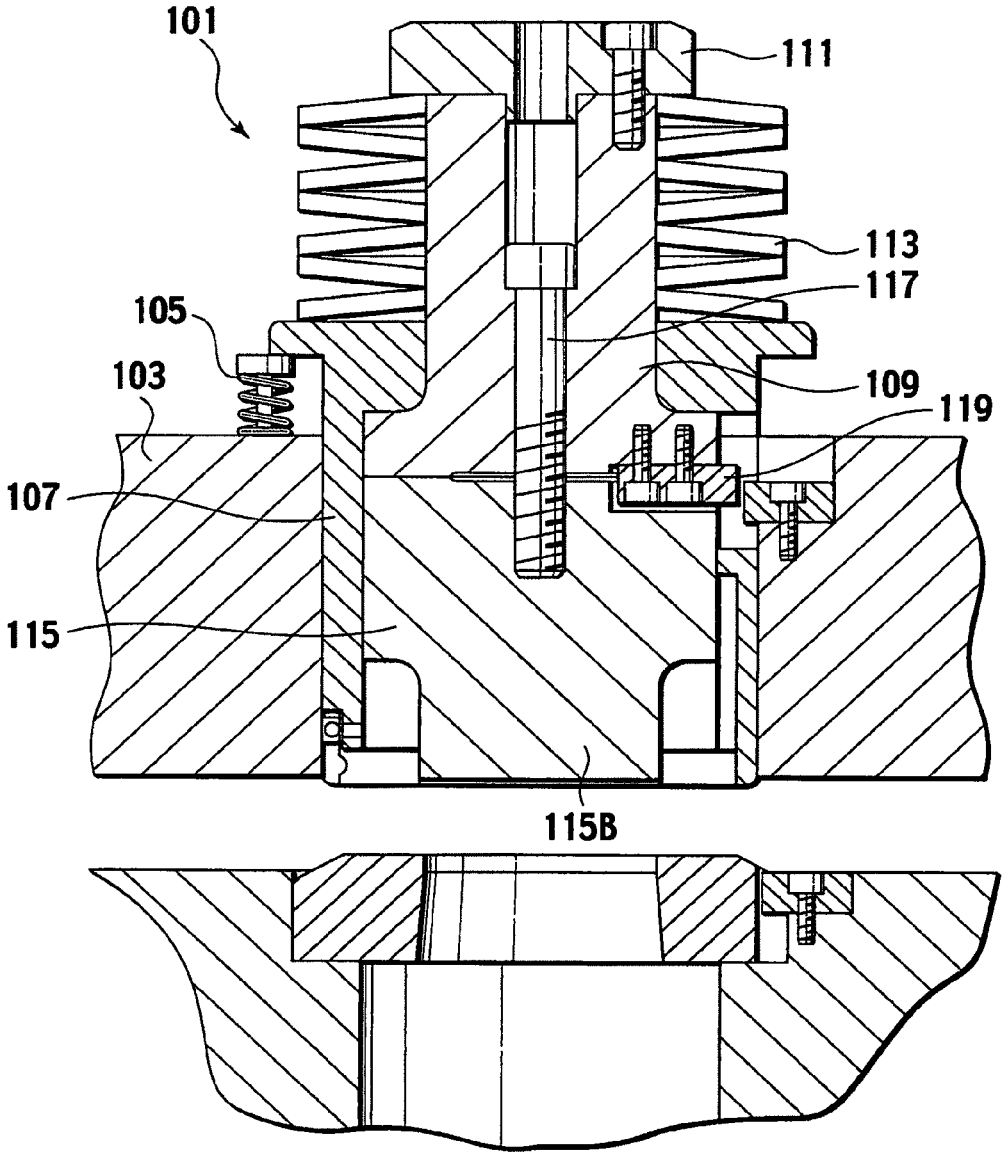
FIG. 1 PRIOR ART
FIG. 1 is a cross-sectional view showing a conventional punch tool.
Figure 2:
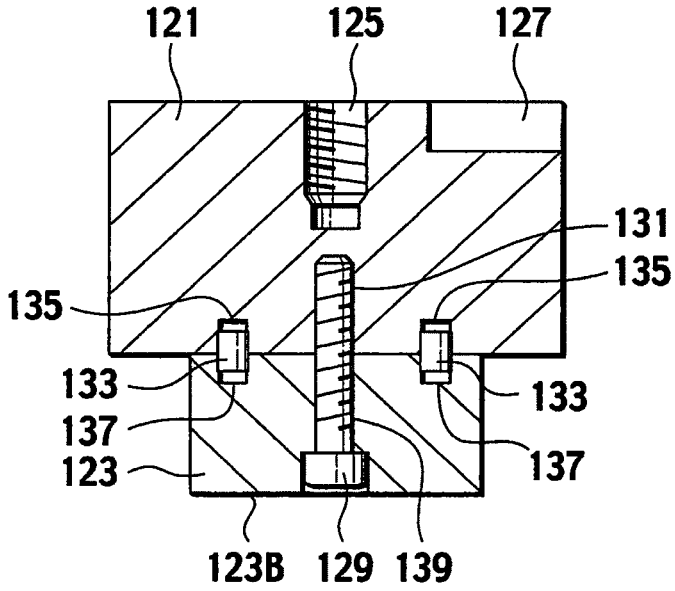
FIG. 2 PRIOR ART
FIG. 2 is an explanatory view showing a conventional configuration of attaching a punch chip to a punch body.
Figure 2:
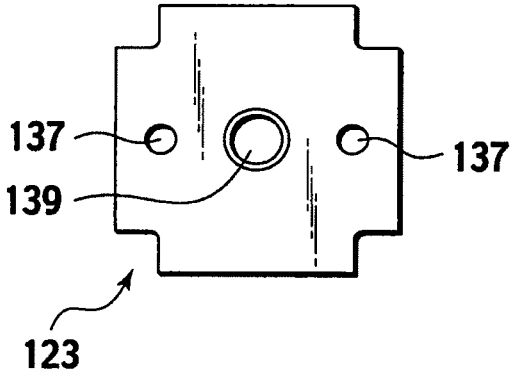
FIG. 2 PRIOR ART

Next, with reference to the drawings, description will be given of a punch tool according to a second embodiment of the present invention. Here, constituent components having the same functions as those in the configuration of the conventional punch tool described above with reference to FIGS. 1 and 2 are denoted by the same reference numerals, and description thereof will be omitted.

Figure 5:
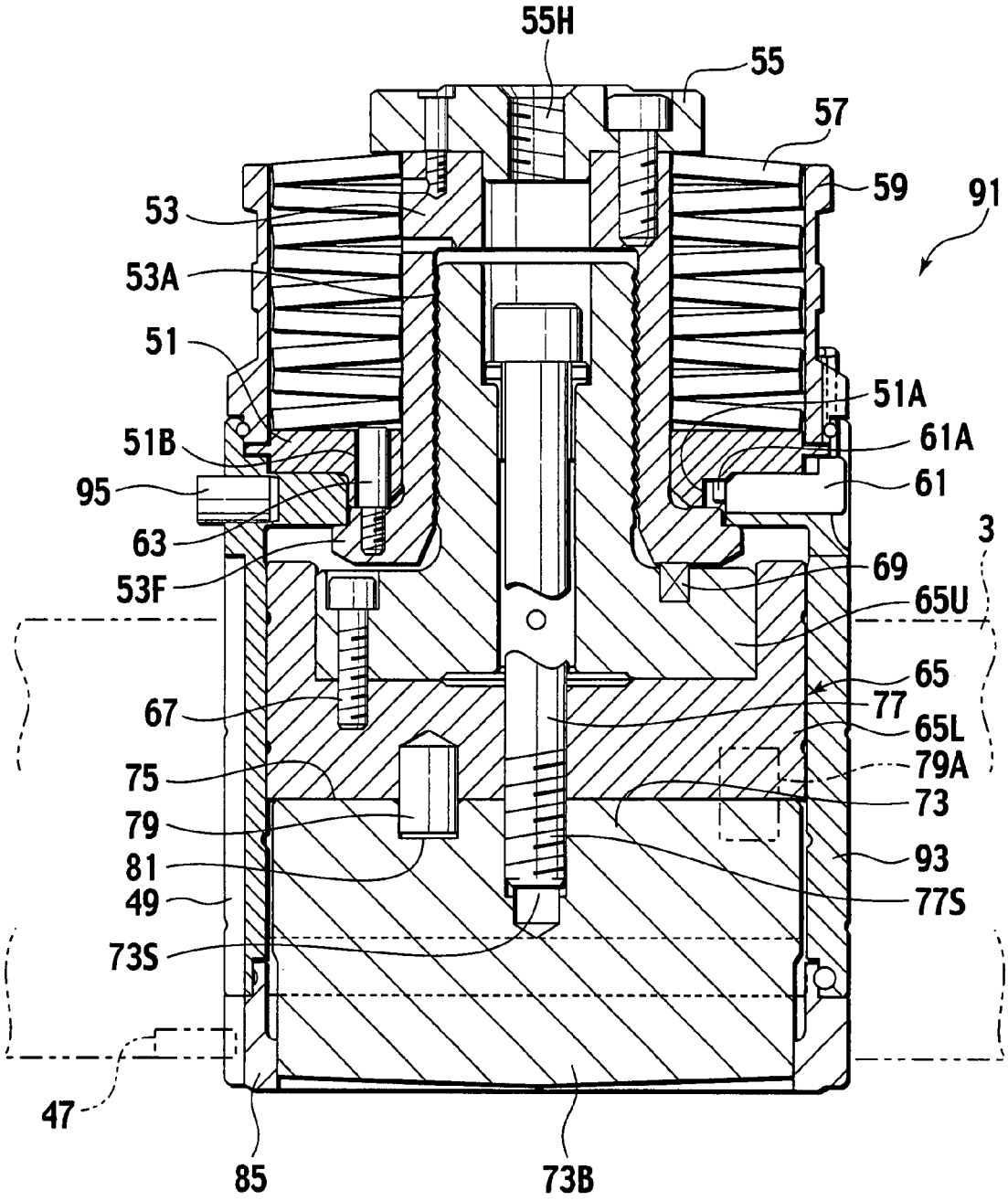
FIG. 5 is a sectional plan view showing a punch tool according to a second embodiment of the present invention.

With reference to FIG. 5, as in the case of the conventional punch tool, a punch tool 91 according to the embodiment of the present invention includes a cylindrical punch guide 93 movably supported in the vertical directions on a punch holder 3 in a punch press. In a plurality of spots on a peripheral surface of the punch guide 93, lifter pins 95 are provided, which are supported by lifter springs 7 (which are configured and operated in the same manner as those in the punch tool of the first embodiment shown in FIG. 3). Moreover, in a plurality of spots (positions where a phase is shifted by 90°) on the peripheral surface of the punch guide 93, key grooves 49 are provided, which can be engaged with or detached from positioning keys 47 attached to the punch holder 3. Therefore, the punch guide 93 can be selectively mounted on the punch holder 3 in a state where the phase is shifted by 90°.

An adjustment ring 51 is rotatably fixably attached to an upper part of the punch guide 93. Between the adjustment ring 51 and a punch head 55 fixed with a bolt or the like to an upper part of a cylindrical punch driver 53 movably in the vertical directions penetrating the adjustment ring 51, a strong elastic member 57 such as a disc spring, for example, is elastically mounted as an example of a stripper spring. Furthermore, a cylindrical protective cover 59 surrounding the elastic member 57 is detachably attached to the upper part of the punch guide 93 by use of appropriate fixtures such as O-rings and set screws, for example.

In order for the adjustment ring 51 to be rotatably fixably formed, engaging concave parts 51A are formed in a plurality of spots of a peripheral surface of the adjustment ring 51. Moreover, locking convex parts 61A are engaged with the engaging concave parts 51A so as to be engaged therewith or disengaged therefrom. Specifically, each of the locking convex parts 61A is provided at a tip of a lock piece 61 provided in the upper part of the punch guide 93 so as to be movable in a radial direction (radiation direction).

Therefore, by operating the lock pieces 61 to release engagement between the engaging concave parts 51A and the locking convex parts 61A, the adjustment ring 51 can be rotated with respect to the punch guide 93. On the contrary, when the engaging concave parts 51A and the locking convex parts 61A are engaged with each other, the adjustment ring 51 is unrotatably fixed to the punch guide 93.

In a flange part 53F provided in a lower end of the punch driver 53, a vertical slide pin 63 is provided so that the punch driver 53 can be vertically moved with respect to the adjustment ring 51 and the punch driver 53 (punch guide 43) is rotated integrally with the adjustment ring 51. The slide pin 63 is slidably fitted into a vertical locking hole 51B formed in the adjustment ring 51. Therefore, the punch driver 53 can be vertically moved with respect to the adjustment ring 51 and is rotated integrally with the adjustment ring 51.

A punch body 65 is movably in the vertical directions included in the punch guide 93. The punch body 65 is divided into an upper punch body 65U and a lower punch body 65L. Specifically, the upper punch body 65U is vertically adjustably screw-fitted to a screw-fitting part 53A inside the punch driver 53. The upper and lower punch bodies 65U and 65L are integrally connected and fixed with a connecting tool 67 such as a bolt.

In a plurality of spots between a lower surface of the flange part 53F in the punch driver 53 and the upper punch body 65U, for example, elastic members 69 such as coil springs are interposed. Moreover, at positions most distant from each other (symmetrical positions with respect to the axis center) on a peripheral surface of the upper punch body 65U, keys 71A and 71B (see FIG. 6) slidably fitted into the key grooves 49 and slots 49S formed in the punch guide 93 are detachably attached with fixtures such as bolts.

Therefore, by the action of the elastic member 69, backlash of the screw-fitted portion between the punch driver 53 and the upper punch body 65U is pulled toward one direction. Thus, a vertical position of the punch body 65 with respect to the punch driver 53 can be more accurately adjusted. Moreover, since the keys 71A and 71B are provided at the symmetrical positions in the upper punch body 65U, a rotation position of the punch body 65 with respect to the punch guide 93 can be more accurately controlled.

Specifically, there are minute clearances, for example, between the key groove 49 and the key 71A and between an inner peripheral surface of the punch guide 93 and an outer peripheral surface of the punch body 65. Thus, the punch body 65 can be slightly moved in the radial direction (radiation direction) with respect to the punch guide 93, can be slightly rotated around the axis center, and can also be slightly slid around the vicinity of the key 71A. The slight movement in the radiation direction, and the like improve accuracy of fitting between the punch guide 93 and the punch body 65, and the movement can be suppressed to be smaller by reducing the minute clearance therebetween.

However, improvement in the accuracy of fitting between the punch guide 93 and the punch body 65 increases processing costs and complicates fitting in assembly. Thus, excessively accurate processing is not desirable. However, in this embodiment, the keys 71A and 71B are provided at the symmetrical positions on the peripheral surface of the punch body 65. Thus, for example, when the punch body 65 tends to be rotated (slid) around the vicinity of the one key 71A, the other key 71B distant therefrom controls the sliding (rotation). Consequently, the direction of the punch body 65 can be accurately maintained by effectively inhibiting the rotation of the punch body 65.

Therefore, when successive punching (punching for obtaining longitudinally successive rectangular holes) is performed in a longitudinal direction by use of a punch having a rectangular cross section, for example, a direction of the punch can always be accurately maintained. Moreover, occurrence of palp (minute chips generated by a slight shift of the punch) and the like can be suppressed.

A punch chip 73 having a punch blade part 73B provided on its lower end is detachably and replaceably attached to the lower punch body 65L in the punch body 65. To be more specific, a punch chip engaging part 75 is formed on a lower surface of the lower punch body 65L. Moreover, a fixing bolt 77 as an example of a fixture for fixing the punch chip 73 engaged with the punch chip engaging part 75 penetrates a middle portion of the lower punch body 65L from above.

Specifically, the fixing bolt 77 having a screw part 77S formed on its lower end fixes the punch chip 73 by penetrating a middle portion (center portion) of the upper punch body 65U from above and having the screw part 77S screwed into a screw hole 73S in the punch chip 73. In the punch chip engaging part 75 of the lower punch body 65L, a positioning locking part 79 such as a positioning pin for positioning the punch chip 73 is provided at a position away from the fixing bolt 77. Moreover, in the punch chip 73, a locked part 81 is provided, such as an engaging hole that can be engaged with or disengaged from the positioning locking part 79.

The positioning locking part 79 such as the positioning pin and the locked part 81 such as the engaging hole are relative to each other. The positioning locking part 79 and the locked part 81 may be provided on either one of the punch body 65 and the punch chip 73.

According to the above configuration, attachment of the punch chip 73 to the punch chip engaging part 75 of the lower punch body 65L requires positioning thereof so that the screw hole 73S provided in the punch chip 73 corresponds to the fixing bolt 77 and that the positioning locking part 79 and the locked part 81 correspond to each other. Thus, it is impossible to perform the attachment by horizontally inverting the punch chip 73 in FIG. 5. Specifically, a direction of attaching the punch chip 73 to the punch body 65 is always set constant.

Figure 6:
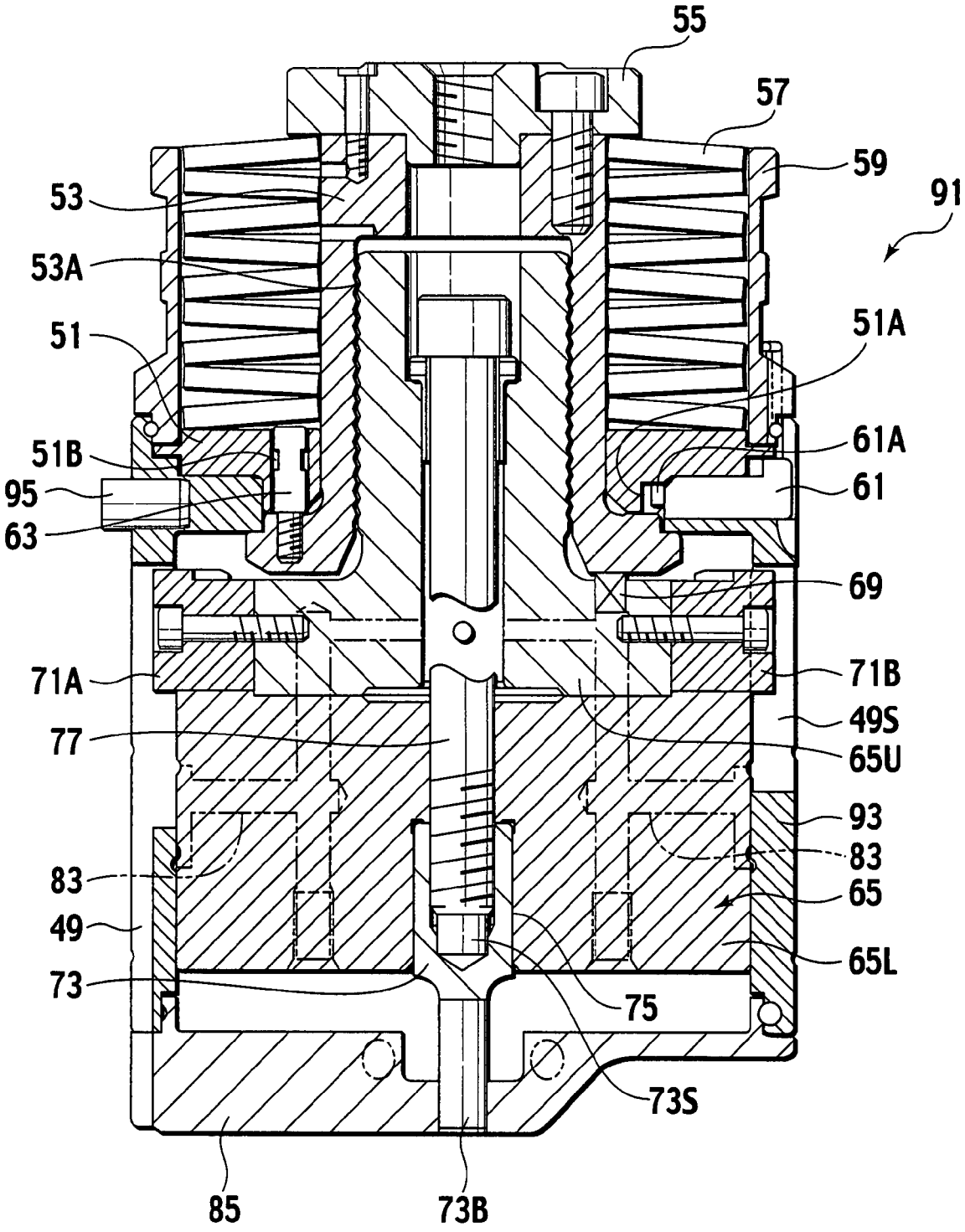
FIG. 6 is a sectional side view showing the punch tool according to the second embodiment of the present invention.

Therefore, in such a case as where, for example, the punch blade part 73B in the punch chip 73 is deviated to the right side in FIG. 6 due to an error in manufacturing of the punch chip 73, a direction of the deviation is constant. Thus, even after the punch chip 73 is mounted on the punch tool 91, a clearance from a die in use can be easily adjusted by using error measurement data in manufacturing without making any change. Specifically, upon use of the punch tool 91 and the die, a deviation amount of the punch blade part 73 in the punch chip 73 is known. Thus, easy adjustment can be made to correct the deviation amount by use of shims or the like, for example.

Note that reference numeral 83 shown in FIG. 6 is an oil mist passage provided in the punch body 65, and reference numeral 85 is a stripper plate detachably and replaceably attached to the lower end of the punch guide 93.

In the configuration as described above, when the punch head 55 is pressed downward by a striker (ram) provided in the punch press after the sheet-like work has been positioned on the die included in the punch press, the punch guide 93 is lowered against the lifter springs 7 (FIG. 3). Accordingly, the work is pressed and fixed to the die by the stripper plate 85, and lowering of the punch guide 93 is stopped. Thereafter, when the punch head 55 is further lowered by the striker against the biasing force of the elastic member 57, punching is performed on the work by the punch blade part 73B of the punch chip 73.

For detaching the punch chip 73 from the punch tool 91, the stripper plate 85 is detached from the punch guide 93, and fixation of the punch chip 73 is loosened by inserting a tool such as a hexagonal wrench, for example, from a through hole 55H provided in the center of the punch head 55 and thus rotating the fixing bolt 77. By the above operation, the punch chip 73 can be detached from the punch body 65. Therefore, when the punch blade part 73B in the punch chip 73 is worn away, the punch blade part can be ground again. Thereafter, when the punch chip 73 is attached again to the punch body 65, the direction of the punch chip 73 is set the same as that before the detachment.

By operating the lock pieces 61 to disengage the locking convex parts 61A of the lock pieces 61 from the engaging concave parts 51A in the adjustment ring 51 after the punch chip 73 has been attached to the punch body 65 as described above, the adjustment ring 51 becomes rotatable with respect to the punch guide 93. Therefore, when the punch head 55 is rotated, the adjustment ring 51 is integrally rotated through the slide pin 63. Specifically, since the punch driver 53 is rotated, the screw-fitted position between the punch driver 53 and the upper punch body 65U can be adjusted. Thus, a fine vertical adjustment can be made on the punch body 65. Moreover, height adjustment can be made so as to correspond to an amount of the punch blade part 73B to be ground.

As is understood from the above description, the punch chip 73 is detachable and replaceable in the punch tool 91. Thus, the punch guide 93, the punch driver 53 and the punch body 65 can be commonly used. Moreover, it is easy to manufacture the punch tool 91 including the punch chip 73 varying in shape. In attachment of the punch chip 73, the direction of the punch chip 73 is always set constant. Thus, for example, even if there is a deviation to one side due to a manufacturing error in manufacturing of the punch chip 73, it is not required to measure the deviation again after the attachment.

Moreover, according to the above configuration, the key groove 49 is provided at the position where the phase is shifted by 90° on the peripheral surface of the punch guide 93. Thus, the direction of the punch chip 73 can be set so as to coincide with an X-axis direction or a Y-axis direction, for example. Furthermore, since the keys 71A and 71B are attached at the symmetrical positions on the punch body 65, for example, it is also possible to detach the keys 71A and 71B once and reset the keys after inverting the punch body 65. Specifically, the punch chip 73 can also be attached by being horizontally or vertically inverted. Note that, in this case, it is also possible to invert the lower punch body 65L and attach the inverted lower punch body to the upper punch body 65U. Specifically, the direction of the punch chip 73 can be changed in four ways.

Meanwhile, the description has been given above of the case where each of the positioning locking part 79 and the locked part 81 is provided at one spot. In the case where the positioning locking parts 79 and the locked parts 81 are provided at a plurality of spots, the same effects can be achieved by providing the positioning locking parts 79 and the locked parts 81 at positions 79A asymmetric to those described above with respect to the center portion of the punch body 65, as shown in FIG. 5.

Besides the above, the present invention is not limited to the description of the embodiments of the present invention. Various other embodiments can be implemented by making appropriate changes.

Note that the entire contents of Japanese Patent Applications No. 2004-339473 (filed on Nov. 24, 2004) and No. 2004-336155 (filed on Nov. 19, 2004) are incorporated herein by reference.

The invention claimed is:

1. A punch tool, including a blade part having a rectangular cross section to form a slit and a slot along a longitudinal direction of the blade part onto a sheet-like workpiece by nibbling process, the punch tool comprising:

a cylindrical punch guide having, on its lower side, a stripper part which presses a periphery of the part to be processed in the workpiece, the stripper part having an insertion hole provided therein;

a punch body including a main body, the punch body being movably provided in the vertical directions in a punch guide and has, on a lower side of the punch body, the blade part that is configured for insertion into the insertion hole;

a punch head provided at an upper end of the punch body;

a body cap provided between the punch head and an upper end of the main body of the punch body, wherein the upper end of the main body of the punch body is screw-fitted to a screw-fitting part inside of the body cap;

a stripper spring which is provided on a lower side of the punch head and which is configured to bias the punch body;

a first rotation control module configured to control rotation of the punch body with respect to the punch guide, the first rotation control module including: a first key groove configured to vertically extend in the punch guide; and a first key provided in the main body of the punch body located on a left side of the main body with respect to the longitudinal direction of the blade part, the first key movably fitted in the vertical direction to the first key groove; and a second rotation control module configured to control rotation of the punch body with respect to the punch guide, the second rotation control module including: a second key groove configured to vertically extend in the punch guide; and a second key provided in the main body of the punch body located on a right side of the main body with respect to the longitudinal direction of the blade part, the second key being movably fitted in the vertical direction to the second key groove;

wherein the first key extends in the radial direction of the punch body; and wherein the first and second rotation control modules are configured to be symmetrical with respect to the longitudinal direction of the blade part of the punch body and respectively located on the left and right sides of the main body with respect to the longitudinal direction of the blade part of the punch body, such that when the punch body is displaced in the circumferential direction around the vicinity of the first rotation control module during the nibbling process, the second rotation control module suppresses the displacement, and when the punch body is displaced in the circumferential direction around the vicinity of the second rotation control module during the nibbling process, the first rotation control module suppresses rattling between the punch body and the punch guide due to the displacement by the nibbling process, thereby eliminating steps in a punched surface of the sheet like workpiece.

2. The punch tool according to claim 1, wherein the first key is fixedly secured to the blade part of the punch body such that a lowermost surface of the first key contacts a bottom surface of a groove provided in the upper portion of the blade part of the punch body so that a top surface of the blade part of the punch body and a bottom surface of the main body of the punch body directly abut with each other based on adjustment of an attaching bolt.

* * * * *